United States Patent [19]

Dimur

[11] Patent Number: 4,903,457

[45] Date of Patent: Feb. 27, 1990

[54] DEVICE FOR EJECTING FILLED ENVELOPES, AND AN INSERTION MACHINE USING SAID DEVICE

[75] Inventor: Gérard Dimur, Epinay Sur Orge, France

[73] Assignee: SMH Alcatel, Paris, France

[21] Appl. No.: 276,607

[22] Filed: Nov. 28, 1988

[30] Foreign Application Priority Data

Nov. 26, 1987 [FR] France ..... 87 16409

[51] Int. Cl.[4] ..... B65H 29/20; B65H 29/58

[52] U.S. Cl. ..... 53/251; 53/266 A; 53/381 R; 53/569

[58] Field of Search ..... 53/569, 266 A, 206, 53/384 R, 382, 381 R, 468, 460, 260, 258, 251, 250, 249

[56] References Cited

U.S. PATENT DOCUMENTS

| | | | |
|---|---|---|---|
| 2,423,146 | 7/1947 | Herbert | 53/569 |
| 2,746,221 | 5/1956 | Rouan et al. | 53/266 A X |
| 2,865,155 | 12/1958 | Nydegger | 53/569 X |
| 3,872,649 | 3/1975 | Wimmer | 53/569 |
| 3,936,993 | 2/1976 | Dorer | 53/266 A |
| 4,633,644 | 1/1987 | Haroutel et al. | 53/266 A X |
| 4,766,715 | 8/1988 | Dimur | 53/266 A X |

*Primary Examiner*—James F. Coan

*Attorney, Agent, or Firm*—Sughrue, Mion, Zinn, Macpeak & Seas

[57] ABSTRACT

The device comprises control evacuation means (40) mounted substantially level with the envelope inlet into the insertion station (1) and tilting means (43, 44) for tilting the filled envelope, with the tilting means being controlled to take up a low tilting position in which they push down said filled envelope around the inlet to the insertion station, after which it is evacuated. The resulting insertion machine is made compact and is accurately controlled during each insertion cycle by a single driving cam shaft (52, 55) including a coding disk for determining successive angular positions.

26 Claims, 7 Drawing Sheets

DEVICE FOR EJECTING FILLED ENVELOPES, AND AN INSERTION MACHINE USING SAID DEVICE

REFERENCE TO RELATED APPLICATIONS

This application relates to U.S. application Ser. No. 07/276,606, filed November 28, 1988, entitled A DEVICE FOR CONTROLLING THE ADVANCE AND THE POSITIONING OF ENVELOPES IN AN INSERTION MACHINE to Jean-Pierre Meur and U.S. application Ser. No. 07/276,738, filed November 28, 1988, entitled A DEVICE FOR INSERTING SHEETS INTO ENVELOPES, to the applicant, and both assigned to the same assignee.

The present invention relates to machines for inserting sheets into envelopes for automatically processing mail. It relates more particularly to an ejection device for ejecting filled envelopes and to an insertion machine including the ejection device.

BACKGROUND OF THE INVENTION

In machines for inserting sheets into envelopes, an envelope unstacker at the outlet from a magazine of envelopes takes envelopes one by one from the magazine. A transfer mechanism transfers the separated envelopes to an insertion station for inserting sheets into said envelopes.

At the insertion station successive envelopes are stopped and held open. The sheets to be put into the envelopes, which may be in the form of single sheets or in the form of bundles of sheets are delivered successively to the machine after being appropriately folded in a folding machine and optionally made up into bundles either before or after folding.

A tray which is movable back and forth and which is referred to as a "carriage" is used for transferring successive sheets that it receives and for inserting them into respective envelopes at the insertion station. The carriage engages itself together with the sheet it is carrying into the open envelope present at the insertion station, and it then withdraws from the envelope leaving the sheet behind. An ejection device serves to eject and remove filled envelopes in order to allow a new insertion to take place.

In such a machine, the number of different devices contained therein give rise to a machine which is excessively bulky, in particular when the machine is intended for use as an item of office machinery, or the like. The mechanisms which control these various devices synchronously further increase the complexity and the bulk of the machine. In order to meet current requirements, these control mechanisms must be capable of operating at high insertion rates with the various devices operating with a high degree of reliability.

The object of the present invention is to satisfy these needs with a machine which is compact, and which is capable of operating reliably at a high throughput.

SUMMARY OF THE INVENTION

The present invention provides an ejection device for ejecting filled envelopes from an insertion station in which sheets are filled into successive envelopes that are brought empty into said station, the device including evacuation means which are operated after each insertion and further including tilting means for tilting said filled envelopes and mounted facing said evacuation means, at least in part, actuator means for actuating the tilting means between a first or "raised" position in which they are at a distance from the plane of the insertion station and leave the station free to be fed with an empty envelope, and a second or "low" ejection position interferring with the plane of the insertion station and pressing said filled envelope against said evacuation means, and reception means for receiving filled envelopes which are evacuated, said reception means being mounted substantially transversely relative to the plane of the insertion station and being coupled to said evacuation means by said tilting means when the tilting means are actuated to take up their low ejection position.

The evacuation means may be mounted substantially at the envelope inlet to the insertion station and the tilting means include at least one evacuation backing wheel carried by a first lever of the tilting means which lever is itself coupled to said actuator means.

The tilting means may further include at least one tilting finger coupled to a second lever of the tilting means, which second lever is itself coupled to said actuator means.

The present invention also provides a machine for inserting sheets into envelopes and making use of said ejection device, said machine further including an empty envelope transfer device in which envelopes are received separate from one another via an arrival chute which is coupled to the inlet of the insertion station, a sheet transfer device in which sheets are received separately from one another on an inlet tray coupled to the inlet of the insertion station, and a control assembly for controlling said devices to perform sequences which are defined relative to each other for each machine cycle, referred to as an insertion cycle, wherein said arrival chute of the empty envelope transfer device and said reception means for receiving filled envelopes evacuated from the ejection device are substantially adjacent and mounted in the proximity of the inlet to said insertion station for the purpose of conveying envelopes along two substantially parallel paths extending substantially transversely relative to the plane of the insertion station.

Said control assembly may include a coding disk mounted on a control drive shaft and a sensor associated with said disk and a delivering clock signals representing different angular positions of said shaft, with said sequences for each insertion cycle for each complete rotation of said shaft being defined on the basis of said clock signals.

Said drive shaft may include an "ejection" first cam having two distinct peripheral portions for putting the tilting means into said raised position and said low ejection position, respectively, and a third intermediate peripheral portion for lowering the anti-return lugs for preventing a sheet from escaping from the envelope, after said sheet has been inserted in the envelope by a sheet-carrying carriage which is movable in translation and which engages itself together with the sheet inside the envelope, while the carriage is withdrawing from the envelope.

BRIEF DESCRIPTION OF THE DRAWINGS

An embodiment of the invention is described by way of example with reference to the accompanying drawings, in which.

MORE DETAILED DESCRIPTION

Figure 1:
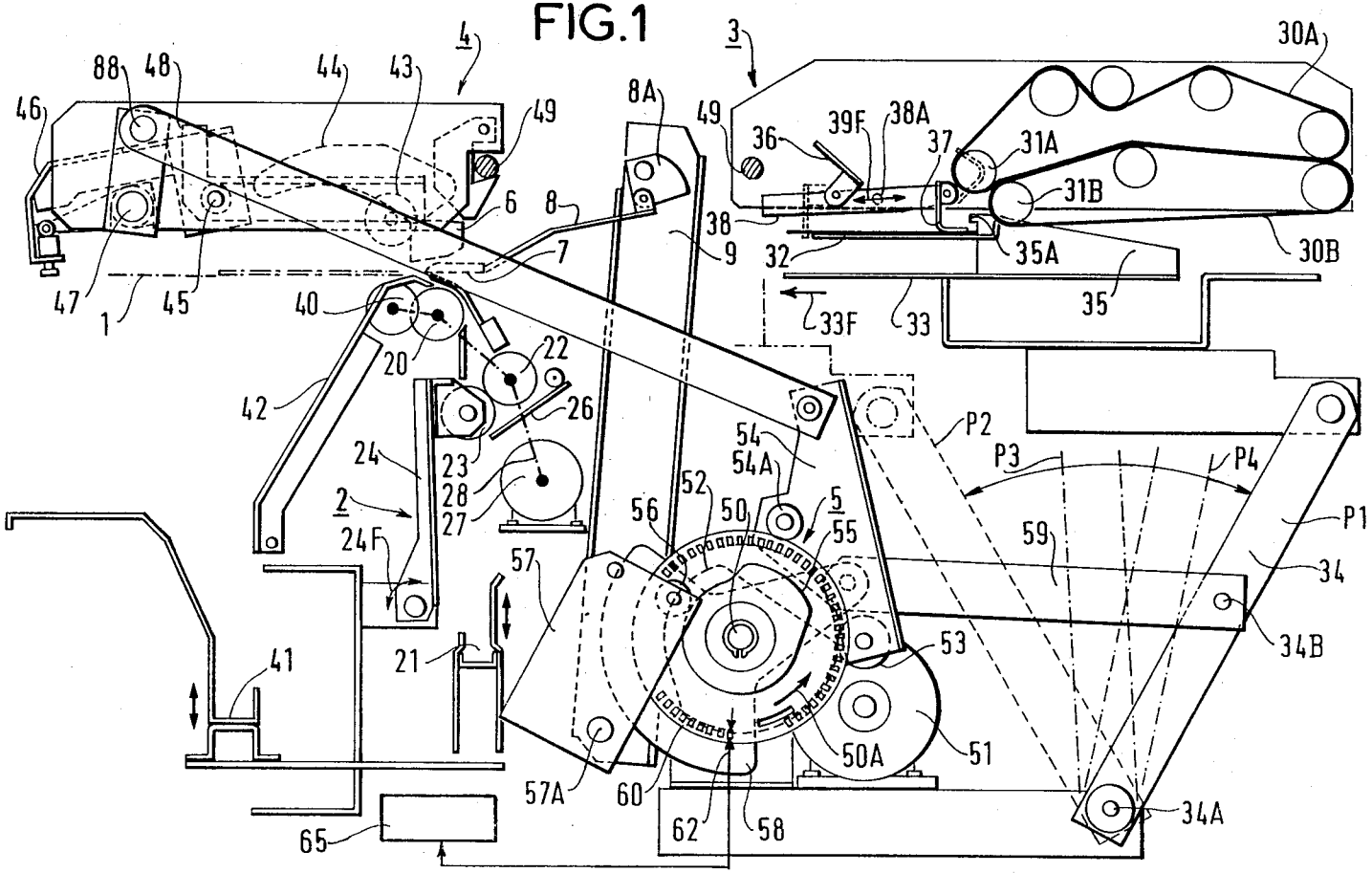
FIG. 1 is a diagrammatic overall view of a machine in accordance with the invention for inserting sheets into envelopes.

FIG. 1 is a diagrammatic elevation view of the machine in accordance with the present invention for inserting sheets into envelopes. The overall structure of this machine is described with reference to said FIG. 1.

The insertion machine comprises:

- a sheet insertion station 1 for inserting sheets into envelopes;
- an empty envelope transfer device 2 for feeding the sheet insertion station with empty envelopes;
- a sheet transfer device 3 for inserting sheets into the successive envelopes presented to the sheet insertion station;
- an ejection device 4 for ejecting filled envelopes, causing successive filled envelopes to be removed from the insertion station; and
- a control assembly 5 for controlling said devices 2, 3, and 4, causing them to perform defined control sequences relative to one another during each successive insertion cycle of the machine.

The sheet insertion station 1 is represented by a single dot-dashed straight line extending substantially tangentially to two wheels 20 and 40 (or two sets of wheels) which do not belong to said station per se, but which are disposed side by side beneath the inlet to the plane of the insertion station. These wheels are described in greater detail below when describing the devices 2 and 4 to which they do, in fact, belong. The straight line segment defines the insertion plane for inserting sheets into envelopes.

The general organization of the empty envelope transfer device 2 is known, per se, and corresponds to the description of the Applicant's French patent application FR-86 07472, and entitled "A device for opening envelopes". Only a brief description of this device is incorporated in the description of the present machine.

The empty envelope transfer device 2 feeds the insertion station with envelopes and also opens the flaps of the envelopes it transfers to the insertion station. It comprises an empty envelope arrival chute 21 which extends substantially horizontally and which is fed with empty envelopes that are separate from one another. These separate empty envelopes come from an unstacker mounted at the envelope outlet from a magazine (not shown). The envelopes are conveyed along said chute 21 which couples the said unstacker to the transfer device 2. In the chute 21, the envelopes are received with their top edges, i.e. the edges from which their flaps are folded, running along the bottom of the chute.

The device 2 includes an extractor drive wheel 22 and an associated extractor backing wheel 23 disposed above the chute 21 for receiving therebetween the bottom edges or the bottom portions of the successive upsidedown envelopes present in the chute and conveyed to said drive wheels. The device also includes an outlet drive wheel which is constituted by the above-mentioned wheel 20 mounted level with the inlet to the insertion station 1. This outlet wheel 20 is mounted above the wheels 22 and 23 and serves to impart an appropriate curvature to each envelope leaving the device 2 for enabling the envelope to penetrate into the insertion station. In practice, it is associated with a backing pressure wheel which is not shown in order to avoid overcrowding the figure.

In this empty envelope transfer device 2, the extraction backing wheel 23 is mounted on a pivot arm 24 which is controlled by an electromagnet (not shown) to move in the direction of double-headed arrow 24F between a rest position where it is at a distance from the extraction wheel 22 and an extraction position in which it presses against the extraction wheel. In the rest position of the extraction backing wheel, the mid-axis of the chute is substantially tangential to said extraction backing wheel. In the extraction position of the extracting backing wheel, the mid-axis of the chute intersects the periphery of the backing wheel so that an envelope pinched between the wheels 22 and 23 is curved. A plate 26 mounted beneath the extraction wheel serves to retain the partially open envelope flap, thereby unfolding it and fully opening the envelope while the envelope is being extracted from the chute 21. The chute 21 is a channel section member having one of its flanges truncated. The back of the envelope together with the partly opened flap faces the larger of the two flanges of the chute. The chute helps impart curvature to the envelope since the envelope can bow out over the shorter flange, simultaneously opening its flap further.

The wheel 40 and the extraction and outlet wheels 22 and 20 are driven by a motor 27. Dot-dashed lines 28 illustrate the coupling between the motor 27 and the wheel 40 and the wheels 22 and 20. This motor is controlled from the control assembly 5 under electronic control described in greater detail below.

The sheet transfer device 3 for transferring sheets to the insertion station 1, for the purpose of inserting each of the sheets it receives into the envelope then present in said station, has the same general organization as that described in the Applicants' French patent application No. FR 84 14 141 entitled "A device for inserting a bundle into an envelope". Neverthless, a portion of the mechanisms have been simplified in accordance with the organization described in the Applicants' co-pending patent application filed on the same day as the present application and entitled "A device for inserting sheets into envelopes".

The latter organization is incorporated briefly in the present application.

The sheet transfer device 3 inserts each sheet it receives into the envelope present at the insertion station. It is fed with separate sheets via a sheet feed path defined by two sets of endless belts 30A and 30B. The belts are kept under tension between guide wheels and only the two terminal guide wheels at the outlet from the feed path are referenced, 31A and 31B. These two references are also used to designate the outlet from the feed path for separate sheets.

The sheet feed path may be fed by a folding machine which may itself coupled to a bundling machine (not shown) and disposed upstream or downstream therefrom. The sheets delivered in this way for insertion into the envelopes may be constituted by single folded sheets, or by a plurality of sheets which may be folded either before or after being bundled together.

The sheet transfer device 3 includes a fixed tray 32 for receiving sheets and mounted beneath the outlet 31A, 31B and extending said outlet towards the insertion station. The fixed tray 32 is disposed slightly above the plane of the insertion station 1 and is at a distance from said station.

The sheet transfer device 3 also includes a serving tray 33 situated substantially in the same plane as the insertion station and serving to transfer and insert sheets into envelopes. The serving tray 33 is mounted beneath the fixed tray as a moving carriage capable of back-and-forth motion along arrow 33F. It has a control lever 34 coupled thereto for the purpose of driving it between a first limit position in which it is practically retracted beneath the fixed tray 32, and a second limit position in which it is partially inside the insertion station 1 and is inserted in the envelope then present in said station. The first position corresponds substantially to that shown in solid lines, and the second position is partially indicated by dot-dashed lines.

The serving tray or carriage 33 carries a pair of pusher fingers 35 which are integral with the tray 33, which are fixed, and which are upstanding on the tray. The pusher fingers 35 also project slightly above the plane of the fixed tray 32 which has two longitudinal windows for receiving them (not shown) with said windows being open at both ends of the fixed tray. Each of the pusher fingers 35 has a leading nib 35A which passes over the sheets in order to ensure that they are pushed by the fingers 35 when the carriage 33 moves towards the insertion station.

The sheet transfer device 3 also includes two sheet retaining fingers 36 mounted above the fixed tray 32 at the front thereof, and holding-down fingers 37 at the rear of the fixed tray immediately downstream from the outlet 31A, 31B from the sheet feed path. The fingers 36 and 37 are coupled to each other by a mechanism which couples them together so that they are controlled together. This mechanism is represented by a lever 38 providing a connection between the two fingers 36 and 37, said lever being hinged substantially about its middle 38A and being coupled to a controlling electromagnet (not shown) which acts on an intermediate portion of the lever as symbolized by arrow 39F when the carriage 33 is advancing towards the insertion station. This causes the retaining fingers 36 and the holding-down fingers 37 to be pivoted, simultaneously and in the same direction about the hinge axis of the lever. As shown, the retaining fingers 36 move into a retracted position and the holding-down fingers 37 move into a holding-down position as soon as the pusher fingers 35 arrive beneath the outlet 31A, 31B to transfer the sheet present on the fixed tray, from said fixed tray to the carriage, and to insert the sheet beneath the leading or forwardly-directed nib 35A of each pusher finger 35. In contrast, the retaining fingers 36 are returned to the position where they constitute a transverse obstacle at the front of the fixed tray and the holding-down fingers 37 are returned to their retracted position above the fixed tray as soon as the sheet has been transferred from the fixed tray to the carriage 33, thereby leaving room for the next sheet to arrive on the fixed tray and to be held on said fixed tray 32. The fingers remain in this position throughout the return stroke of the carriage 33. During the return stroke of the carriage beneath the fixed tray, it is specified that the pusher fingers 35 pass beneath the waiting sheet and they raise it slightly as their leading portions having the nibs 35A formed thereon go past, thus producing a "humped-back" effect which disappears when the leading nibs move beyond the outlet 31A, 31B.

The ejector device 4 for ejecting filled envelopes comprises the above-mentioned wheel 40 mounted together with the wheel 20 beneath the inlet to the insertion station, with said wheel 40 being an ejection drive wheel. Like the wheel 20, the wheel 40 is constituted, in practice, by a set of wheels mounted on a common shaft. The ejector device 4 also includes a mechanism for tilting envelopes to be removed from the insertion station (not given an overall reference), an envelope reception chute 41, and a guide 42 between the wheel 40 and the chute 41.

The guide 42 is mounted sloping beneath the insertion station and serves to provide coupling between the insertion station (or more precisely its envelope inlet level with the wheel 40) and the chute 41. This chute 41 which is also beneath the insertion station is horizontal and extends parallel to and at a small distance from the chute 21 belonging to the station 2 for transferring empty envelopes. Filled envelopes leaving the transfer station are received with their bottom edges being received in the bottom of the chute 41. Like the chute 21, the chute 41 is a channel section member having a truncated flange, and it is equipped along its length with wheels (not shown) for driving the filled envelopes it receives in the direction opposite to that in which empty envelopes are driven along the chute 21.

Both of the chutes 21 and 41 are similarly adjustable in level relative to the plane of the insertion station 1 in order to take account of different types of envelopes to be filled. A double-headed arrow associated with the chutes, but not referenced, illustrates this vertical adjustment.

The mechanism for tilting filled envelopes comprises a backing wheel 43 associated with the ejector wheel 40 and pivotally mounted, together with pivoting tilting fingers 44.

They are controlled by individual levers (not referenced in FIG. 1) which are pivotally mounted and which are caused to move simultaneously about a common hinge axis 45 by a control lever 46. The control lever 46 is itself controlled by a set of other levers (not referenced) which are hinged to a shaft 47 and which couple the control lever 46 to a control link 48. The link 48-is actuated by the control mechanism 5. These various levers, and the control thereof, are described in greater detail below.

The ejection device 4 is carried by the hinge shaft 47 and on a support shaft 49 to which it is normally locked, but from which it can be unlocked as described below.

In FIG. 1, the shaft 49 is shown twiceover; once in the facing end portions of the ejector device 4; and once the sheet insertion device 3. In practice, it is constituted by a single shaft, but the sheet insertion device which is also carried by said shaft has been offset to the right in FIG. 1 in order to clarify FIG. 1.

Anti-return lugs 6 for preventing the return of a sheet inserted in an envelope present in the insertion station 1 are associated with the ejection device 4. Although properly speaking these anti-return lugs 6 do not belong to the ejection device 4, they are mounted therein, and they are pivotally mounted about the hinge shaft 45 under the control of the lever 46 which is itself controlled by the link 48 as described below.

These anti-return lugs 6 are above the insertion station 1 facing the envelope inlet to said station.

Figure 7:
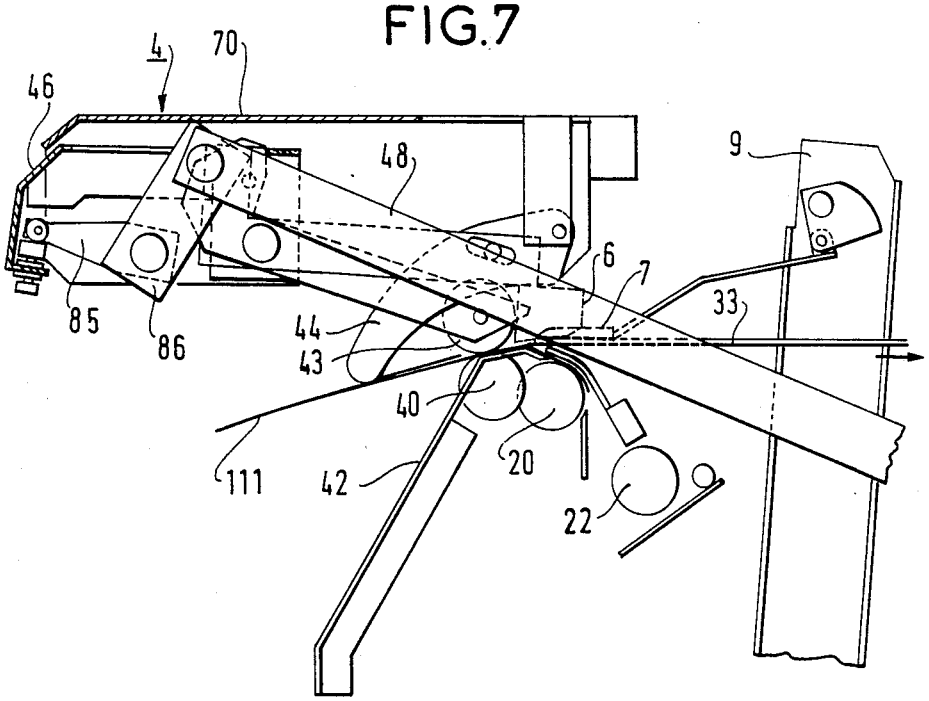

In addition to the devices 2, 3, and 4, and the anti-return lugs 6 mounted in the device 4, the machine illustrated in FIG. 7 includes fingers 7 for opening the body of an envelope present in the insertion station.

These opening fingers 7 are mounted over the insertion station and substantially facing the envelope inlet to the insertion station. They are formed at the ends of individual supports 8 whose opposite ends are coupled by hooking tabs 8A to a common actuator lever 9.

The control assembly 5 essentially comprises a drive shaft 50 having cams mounted thereon and driven in the direction of arrow 50A by a control motor 51. This shaft 50 has a first cam 52 for controlling the ejection device 4 and referred to as the ejection cam. An ejection wheel 53 carried by a hinged lever 54 bears against the ejection cam 52. The lever 54 is hinged about a fixed axis 54A and is also coupled to the link 48 for controlling the ejection device under its control.

The same shaft 50 also carries a second cam 55 for controlling the opening fingers 7, with said cam being referred to as the envelope body opening cam. An opening control wheel 56 bears against the opening cam 56 and is carried by a support lever 57. This lever 57 is coupled to the lever 9 at a fixed hinge axis 57A and it controls the lever 9 to actuate the opening fingers 7.

The shaft 50 also controls a connecting link and crank system whose crank 58 constitutes a flywheel fixed to the shaft and drives a connecting link 59. This link 59 is itself hinged to the lever 34 which controls the carriage 33 in order to move it back and forth. The lever 34 has one of its ends coupled to the carriage and has its other end coupled to a fixed hinge axis 34A. It is hinged substantially in the middle to the link 59 by a hinge 34B.

With respect to this carriage drive, references P1 and P2 designate the substantially extreme positions taken up by the lever 34 for controlling the carriage 33, while references P3 and P4 mark two special intermediate positions.

The same shaft 50 also carries a disk 60 for encoding the angular position of the shaft.

A photoelectric cell referenced 62 delivers this angular position. The disk 60 has a plurality of regularly spaced-apart identical openings which are detected by the sensor 62 in order to deliver successive angular positions of the shaft 50. The disk 60 also has a single, larger opening which is also detected by the sensor and serves to define a reference position. These openings are not referenced in FIG. 1, and they are described in greater detail below. The sensor 62 is coupled to a counter 65.

Figure 2:
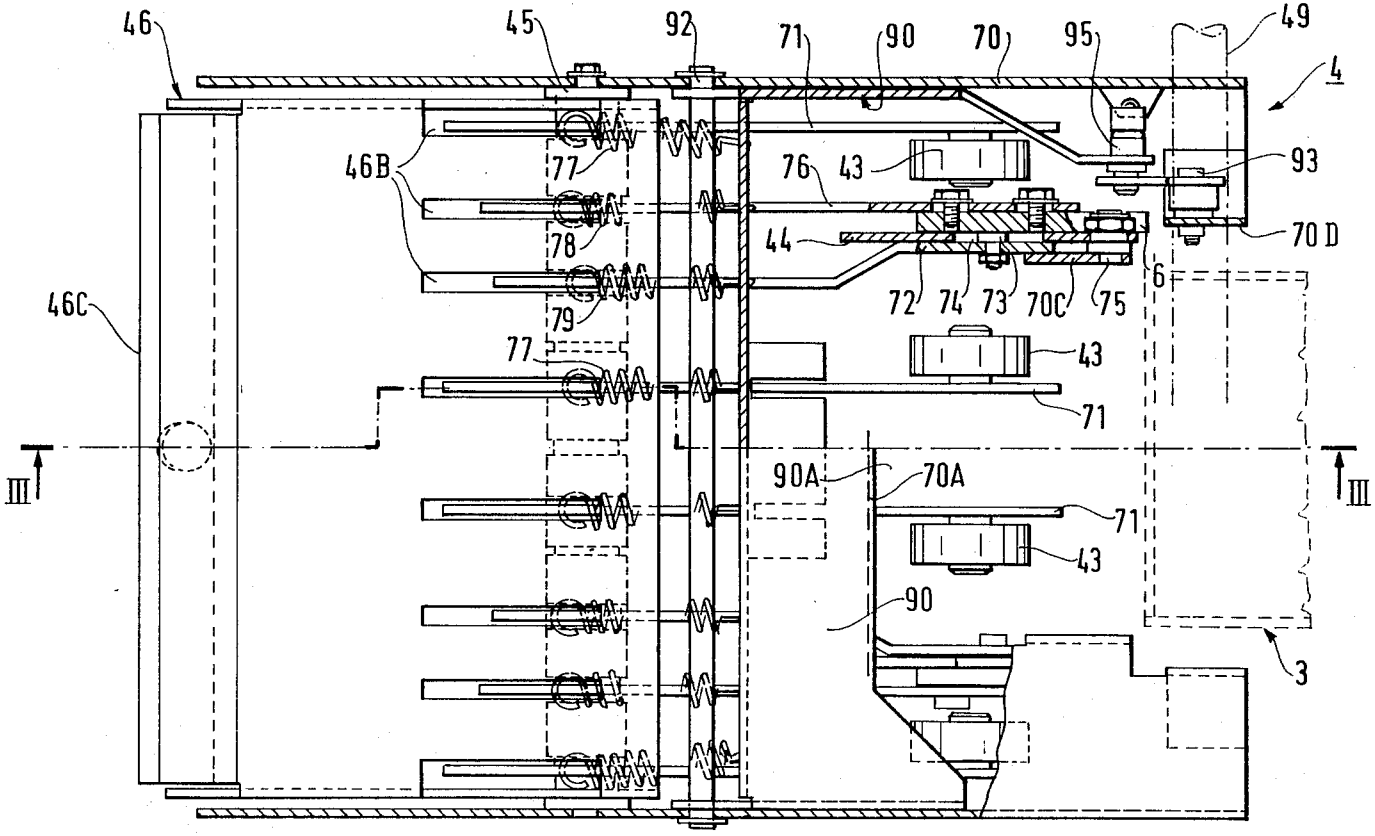
FIG. 2 is a plan view in partial section of the ejection device according to the present invention for ejecting filled envelopes and included in the machine of FIG. 1, with FIG. 2 being on a larger scale than FIG. 1.
Figure 3:
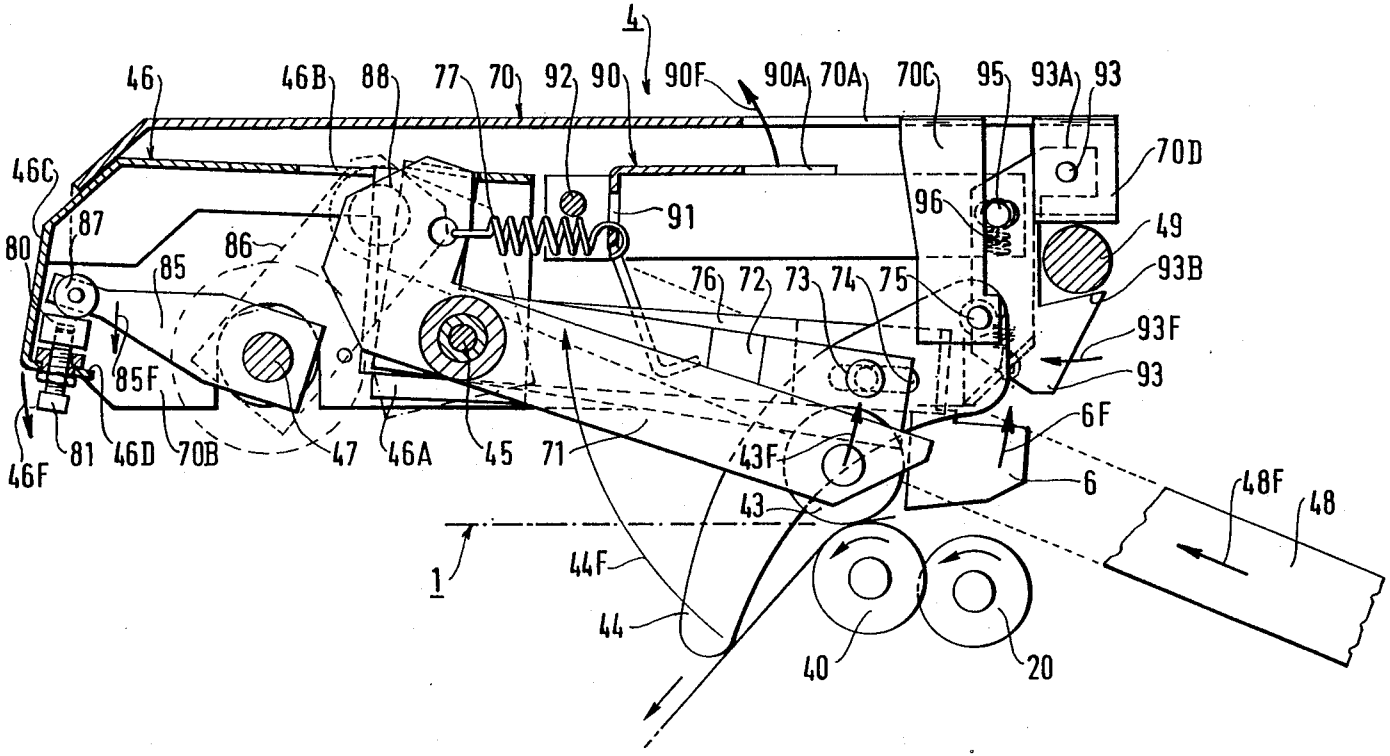
FIG. 3 is a section view on line III—III of FIG. 2 showing the components of the ejection device in their lowered ejection position.

FIG. 2 is a plan view in partial section of the ejection device 4 in said insertion machine, and FIG. 3 is a cross-section through the ejection device with its components shown in the envelope-ejection position for purposes of clarity and to facilitate explaining the structure of the ejection device 4. In FIG. 3, the backing wheels 43 pressing against the ejection wheels 40 which are then being driven like the wheels 20 show that this is the ejection position. In FIG. 2, the beginning of the sheet transfer device 3 is also shown. In FIGS. 2 and 3, items which are already mentioned with reference to FIG. 1 carry the same references as were used when describing FIG. 1.

With reference to one or other or both FIGS. 2 and 3, it can be seen that the components of the ejection device 4 are mounted in a frame 70 carried by shafts 47 and 49 and situated above the ejection station. The frame is an upsidedown channel section member. It has a window 70A in its web opening to the end of the frame 70 situated above the envelope inlet into the insertion station. The flanges of the channel section member are referenced 70B.

Within the frame 70, the ejection backing wheels 43, which are four in number, are wheels mounted free to rotate close to the ends of respective levers 71. The tilting fingers 44, which are two in number, are coupled to respective end portions of individual levers 72.

These tilting fingers 44 are curved and profiled so as to be generally comma-shaped with the concave surface facing the inlet to the insertion station which, in FIG. 3, can be seen to be situated at the wheels 40 and 20. Each tilting finger 44 is coupled to its lever 72 by means of a link stud 73 fixed to the lever 72 and mounted in a small oblong window 74 provided in the tilting finger. The window 74 extends substantially across the thicker end (corresponding to the top of the comma) of the tilting finger level with the transition between said end and the concave surface of the finger. Each of these tilting fingers is also mounted at its thicker end by means of a hinge connection about a fixed hinge pin 75 carried by a plate 70C belonging to the frame 70 and adjacent to the window 70A in the frame, said plate extending parallel to the side flanges 70B and being further inside the frame 70.

The anti-return lugs 6 which are mounted inside the ejection device 4 are fixed to respective terminal portions of individual levers 76, they are screwed to their levers and form tabs extending transversely relative thereto projecting towards the inlet to the insertion station.

The individual levers 71, 72, and 76 are in the form of L-shaped cranks with the ejection backing wheels 43, the tilting fingers 44, or the anti-return lugs 6 as the case may be, being disposed at the end portions of the long arms of their respective L-shapes. These levers 71, 72, and 76 are hinged about a common hinged shaft 45 mentioned above and passing through them substantially at the right angle between their long and short arms. These levers 71, 72, and 76 are mounted in the frame 70 so as to be resiliently biased by individual springs such as 77, 78, and 79 each of which is fixed to the short arm of the L-shape of the corresponding lever and to an auxiliary piece 90 located inside the frame (FIG. 3) and described in greater detail below. These springs 77, 78, and 79 keep the inside end portions of the short arms of the levers 71, 72, or 76, as the case may be, in abutment against the above-mentioned control lever 46 of the ejection device 4.

This control lever 46 itself constitutes a frame for the set of levers. It is inside the frame 70 of the ejection device 4 and of substantially the same width. It extends inside the frame 70 from the middle portion of said frame 70 up to its end furthest from the end lying over the inlet to the insertion station. It is constituted by an upsidedown channel section member and its side flanges are truncated in order to pass freely around the support shaft 47, other than in the end portion lying substantially in the middle of the frame 70 where the flanges are full length and referenced 46A. This end portion of the lever 46 is hinged about the shaft 45 of the levers 71, 72, and 76 which passes through the non-truncated portions 46A of its flanges.

This same upsidedown channel section control lever 46 includes elongate windows 46B in its web through which the ends of respective ones of the levers 71, 72, and 76 pass with the inside terminal edge of the short arm of each of the levers 71, 72, and 76 coming into abutment (FIG. 3) substantially vertically over the shaft 45 with the end of its corresponding window 46B under the effect of its individual spring.

At the other end of the lever 46 close to the end of the frame 70, the web of the lever 46 is folded to close the end of its channel section and define a front face 46C at the front of the frame 70. This front face 46C itself has an inwardly folded lip 46D at the end of the lever 46. This lip 46D carries an internal buffer 80 serving as an abutment and adjustably fixed at the end of a holding screw 81 which passes through the lip 46D.

This control lever 46 which constitutes a frame for the set of levers 71, 72, and 76 that it controls is assembled by welding.

It is in turn controlled by two levers 85 and 86 which are coupled to each other by a shaft which passes through one end of each of them. The other end of the lever 85 has a terminal wheel 87 bearing against the abutment buffer 80 carried by the lever 46. The other end of the lever 86 is hinged at 88 to the end of the control link 48. The lever 85 is inside the frames 70 and 46, while the lever 87 and the link 48 are outside the frame 70.

Inside the frame 70, the piece 90 occupies substantially all of the room left free by the control lever 46, i.e. it runs substantially from the middle portion of the frame 70 to its end lying over the envelope inlet into the insertion station 1.

This piece 90 serves as an anchor point for the above-mentioned springs 77–79 and also as locking means and manually controlled unlocking means for fixing the ejection device 4 to the support shaft 49. The piece 90 is in the form of an upsidedown channel section member whose flanges are relatively small and not referenced. It is mounted over the long arms of the L-shaped levers 71, 72, and 76. In the middle of the frame 70 and facing the lever 46 it has a folded-down and cut-out edge 91 to which the springs 77, 78, and 79 are fixed.

The end portion of the piece 90 situated in the middle of the frame 70 is pivotally mounted in the frame 70 to a fixed shaft 92. It has a window 90A through its web beneath the window 70A of the frame 70 for manual unlocking purposes like a hand-operated handle.

This piece 90 controls two retractable locking fingers 93 via its end opposite to that hinged to the shaft 92 and serving to hold the device 4 normally locked to the support shaft 49.

These fingers 93 are individually fixed to respective inside sides of the frame 70 at its end lying over the envelope inlet to the insertion station 1, with the flanges 70B of the frame 70 being considerably truncated at this point. Each finger 93 is pivoted via an end tab 93A on a pin 94 carried by a short terminal flange 70D running along the inside of the window 70A through the frame 70, near the open end of the window. It extends towards the insertion station in the form of a locking catch 93B facing the short terminal flange 70D at the truncated end portion of the flange 70B in order to clamp the shaft 79 between itself and the short flange 70D.

Each finger 93 also has its intermediate portion coupled to the end of the control piece 90 by a hinge 95 and is urged towards a non-retracted position against the support shaft 49 by a spring 96 in the absence of an opposing force exerted by the piece 90. The spring 96 is fixed at one end level with the hinge 95 and at its other end on the sloping inwardly folded edge of the flange 70B of the frame 70.

When the control piece 90 is not manually operated, the locking fingers 93 are in the non-retracted position as shown in FIG. 3, thereby locking the device 4 onto the shaft 49. When the control piece 90 is actuated through the windows 70A and 90A as symbolized by arrow 90F, then the piece 90 pivots about the shaft 92, thereby pivoting the locking fingers 93 which remain coupled to the piece 90 and which also pivot about their fixed pins 94 against the force of their return springs 96, thereby releasing the shaft 94 and moving to the retracted position as symbolized by arrow 93F.

FIG. 2 also shows the beginning of the sheet transfer device 3 which is likewise carried by the support shaft 49. It can be seen that this device 3 is engaged a short distance into the end portion of the device 4. It fits into the inside portion left empty between the flanges 70C and 70D on either side of the window 70A through the frame 70.

In FIG. 3, in addition to the arrows 90F and 93F which illustrate the action of the piece 90 and action it transmits to the locking fingers, an arrow 48F illustrates the command exerted by the link 48, and arrows 85F and 46F illustrate the corresponding commands transmitted to the lever 85 and to its terminal wheel 87 and then by these members to the lever 46. These commands are transmitted by the lever 46 to the levers 71, 72, and 76 in order to control the items which they carry. Arrows 43F, 44F, and 6F illustrate the commands applied to the ejection backing wheels 43, the tilting fingers 44, and the anti-return lugs 6 for preventing sheets inserted in the envelopes from escaping, which commands follow naturally from those exerted by the levers and not represented by individual arrows. These commands serve to move the levers to their high positions as shown in FIG. 1.

Figure 4:
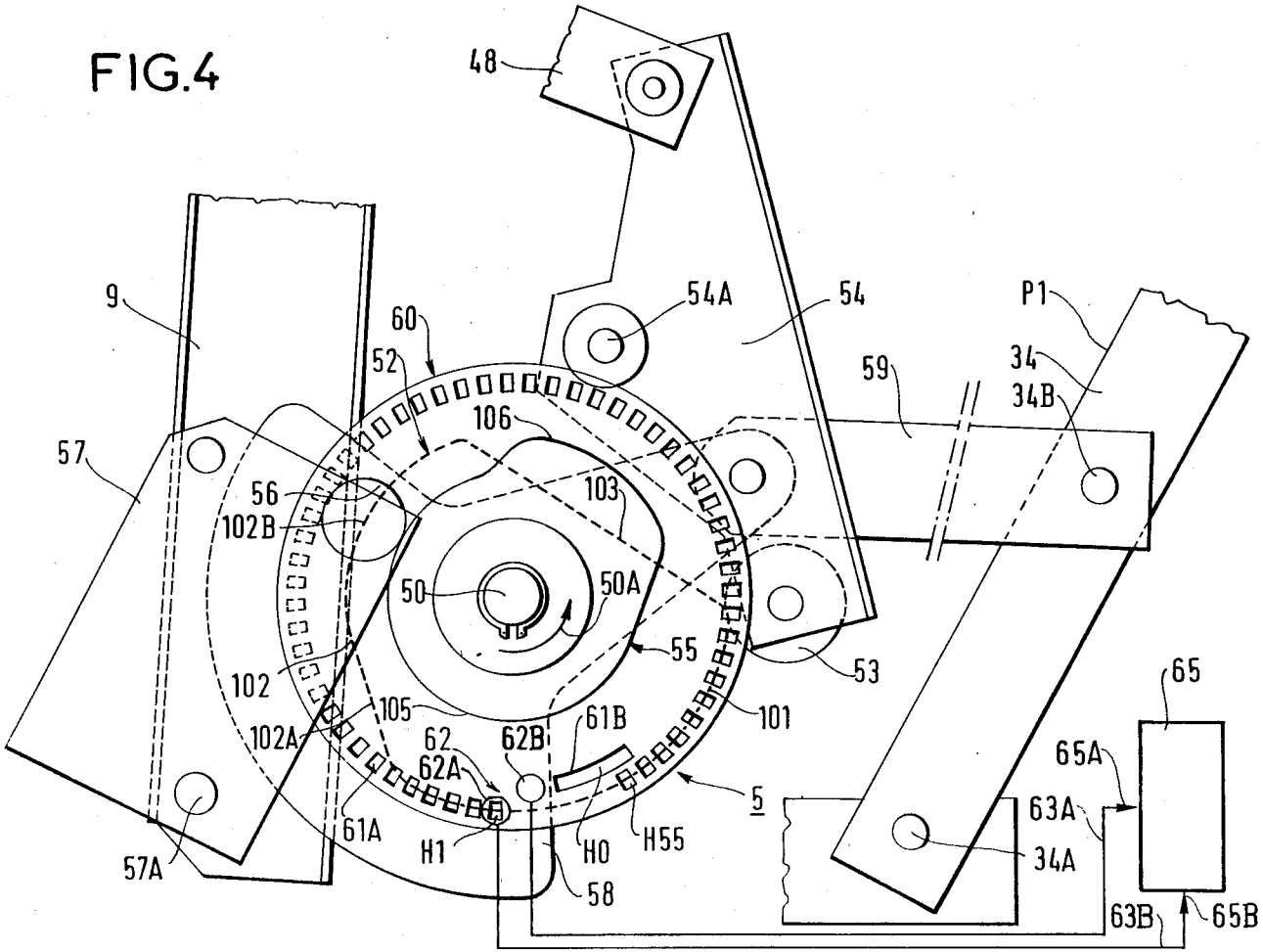
FIG. 4 is a view on a larger scale of the control device for the machine of FIG. 1.

These commands come, in particular, from the control device 5 which is shown in detail in FIG. 4.

In FIG. 4, items which have already been mentioned with reference to FIG. 1 are designated by the same references.

The periphery of the ejection cam 52 mounted on the driving cam shaft 50 and against which the control wheel 53 is pressed is essentially constituted by three successive distinct portions referenced 101, 102, and 103, with each portion occupying a sector of about 120°. The portion 101 is circular and is the radially outermost portion of the periphery. The portion 103 constitutes a flat on the ejection cam and is the portion which projects least, radially. The portion 102 is intermediate, and is itself constituted by two portions of similar length, having a substantially linear portion 102A adjacent to the portion 101, and a substantially semi-circular portion 102B adjacent to the portion 103. The portion 101 is referred to as the "rest" portion, the portion 103 is referred to as the "ejection" portion, and the portion 102 is a transition portion between the portions 101 and 103, with said terms being derived from the control effects which said portions transmit to the ejection device via the wheel 53, the lever 54, and the link 48.

The flywheel 48 rotates with the shaft 50 which drives it. The system comprising the link 59 and the lever 34 transforms this rotary motion of the flywheel 58 into alternating motion which is transmitted to the carriage of the sheet insertion device 3, imparting a variable speed to the carriage along its "go" stroke towards the insertion station and also along its "return" stroke.

The periphery of the cam 55 for opening the envelope bodies and mounted on the drive shaft 50 has the control wheel 56 pressed thereagainst, and essentially comprises two portions 105 and 106 both of which are semicircular, but having different radiuses. The portion 105 is considerably longer than the other portion 106, however its radius is smaller than that of the portion 106. These portions 105 and 106 are separated by substantially linear transitions for rapidly changing the imparted control position. The portion 105 is the "rest" portion and the portion 106 is the envelope "body-open" portion, with said terms being related to the effects they transmit to the opening fingers via the wheel 56 and the control lever 9.

The coding disk 60 which is also mounted on the drive shaft 50 and which is caused to rotate together with the cams 52, and 55, enables the relative positions of the cams and the flywheel 58 to be accurately determined for the progress of the mechanical controls they provide. Also, with respect to the various control sequences defined relative to one another for each insertion cycle, the disk makes it possible to ensure that the sequences under mechanical control take place at the appropriate times relative to sequences under electronic control and based on sensor 62 and on counter 65 on the basis of the coding disk 60 of the control mechanism 5.

To this end, the disk 60 has a series of small openings such as 61A formed at a regular pitch around nearly all of its periphery except for a small gap having no such openings. The disk 60 is shown as having 55 small openings 61A and the small gap corresponds to 5 missing openings. The sensor 62 comprises two sensors, with two emitting cells associated with two respective receiving cells. One of the sensors 62A in this pair of sensors is mounted in association with the small openings 61A. References H1 and H55 at the periphery of the disk and facing the end most openings constitute the end most clock signals generated when all of the illustrated 55 small openings 61A are detected as they pass the sensor 62A during one complete rotation of the disk 60 and the shaft 50. Said sensor 62A is coupled to a count input 65A of the counter 65.

The disk 60 also has a long opening 61B which is formed slightly further in from the edge of the disk than the small openings 61A and which extends, at least in part, level with the gap having no openings 61A. The second sensor 62B of the pair of sensors 62 is mounted to detect said longer opening 61B.

Each time the long opening 61B passes in front of the second sensor 62B of the pair of sensors 62, the second sensor 62B generates a clock signal reference H0 representative of a reference or rest angular position of the machine. This second sensor is shown as being coupled to a reset-to-zero input 65B of the counter 65. This clock signal H0 corresponds to a small number of signals such as H1, H2, H3, . . . , H55, and has a duration of between 2 and 5 of said signals, in order to provide a range which is large enough to enable the shaft 50 to come to rest if the machine is to stop.

As shown in FIG. 4, it is advantageous for the longer opening 61B to extend level with the end most small opening 61A giving rise to the signal H55 and to continue therefrom over a portion of the gap having no small openings 61A. In this case, said portion corresponds to 3 of the 5 missing openings. The sensor 62B is offset angularly relative to the sensor 62A by a corresponding amount, i.e. by two steps of the clock H1 to H55. This offset compensates for the longer opening 61B not being centered over the entire gap having no openings 61A. It also serves to facilitate mounting the two sensors by using optical fibers 63A and 63B coupled to two detector cells which are remote from the disk 60 and to two emitting cells in order to detect the passages of said openings, while avoiding interference between either of the emitting cells and the fiber associated with the other emitting cell.

By virtue of this disposition, when the sensor 62A provides a clock signal H55, the longer opening 61B is still not level with the sensor 62B. However, as the shaft continues to rotate, after the clock signal H55 is over, the longer opening 61B reaches the sensor 62B and the signal H0 is generated. However, when the sensor 62A gives rise to a new clock signal H1, the long opening 61B has left its sensor 62B so that the clock signal H1 and the following signals H2, . . . , H55 are recorded by the counter 65.

The essential operating sequences of the machine are described below with reference to the clock signals which are mentioned below for an insertion cycle performed by one complete turn of the driving cam shaft 50. These sequences are given for a single sheet format.

Sequence 1—carriage advance sequence

This sequence corresponds to clock signals H0 to H28, with the sheet beginning to be inserted into the envelope at H14 and with the sheet being fully inserted in the envelope at H28, said insertion being provided by the mechanical commands transmitted to the lever 34, by the rod and crank system 59, 58. The following two sub-sequences also take place during said sequence 1.

A first sub-sequence in which the sheet is transferred from the fixed inlet tray 32 to the carriage under electronic control based on the sensor 62 and the counter 65 and taking place from H0 to H14 with the retaining fingers 36 being retracted and the holding-down fingers 37 being lowered.

A second envelope body opening sub-sequence controlled mechanically by the cam 55, takes place from H10 to H20.

Sequence 2—sheet in envelope retaining sequence

This sequence is controlled mechanically by the cam 52 from signals H24 to H54. During this sequence the anti-return lugs 6 are in the low position.

Sequence 3—carriage return sequence

This sequence runs from signal H28 to signal H0, with the carriage being fully withdrawn from the envelope as from H42. It is mechanically controlled by the rod and crank 59–58.

Sequence 4—envelope ejection and feed sequence

This sequence extends from H41 to H5 and comprises two sub-sequences:

A first, tilting sub-sequence which rapidly lowers the envelope tilting components from H41 to H44, after which these components are held down from H44 to H53, and they are then raised from H53 to H0. This first sub-sequence is controlled mechanically by the cam 52.

A second, transfer and ejection sub-sequence in which the drive wheels 20 and 40 are switched on, both for bringing in an empty envelope and for ejecting a filled envelope. This sub-sequence is under electronic control and it is triggered by the sensor 62 and the counter 65, and extends from signal H45 to signal H5.

Insertion cycles follow one another with their essential sequences interfitting or overlapping as the case may be. When the machine is started, insertion cycles are preceded by an initialization cycle in which an empty envelope is brought to the insertion station and a sheet is brought to the insertion station. When an overall stop command is given, the machine comes to rest in its reference position as indicated by the appearance of the signal H0.

FIGS. 5, 6, 7, and 8 illustrate the operation of the ejection device 4 for ejecting filled envelopes from the insertion station, as it progresses through an insertion cycle of the overall machine shown in FIG. 1. This operation of the ejection device 4 is given below with reference to sequences of an insertion cycle of the machine mentioned above with reference to FIG. 1 which shows the machine overall and with reference to FIG. 4 for specifying the corresponding clock signals. In each of FIGS. 5 to 8, other items of the machine that come into the proximity of the ejection device 4 are also shown, where appropriate. The items illustrated have the same references as were used in the preceding figures.

Figure 5:
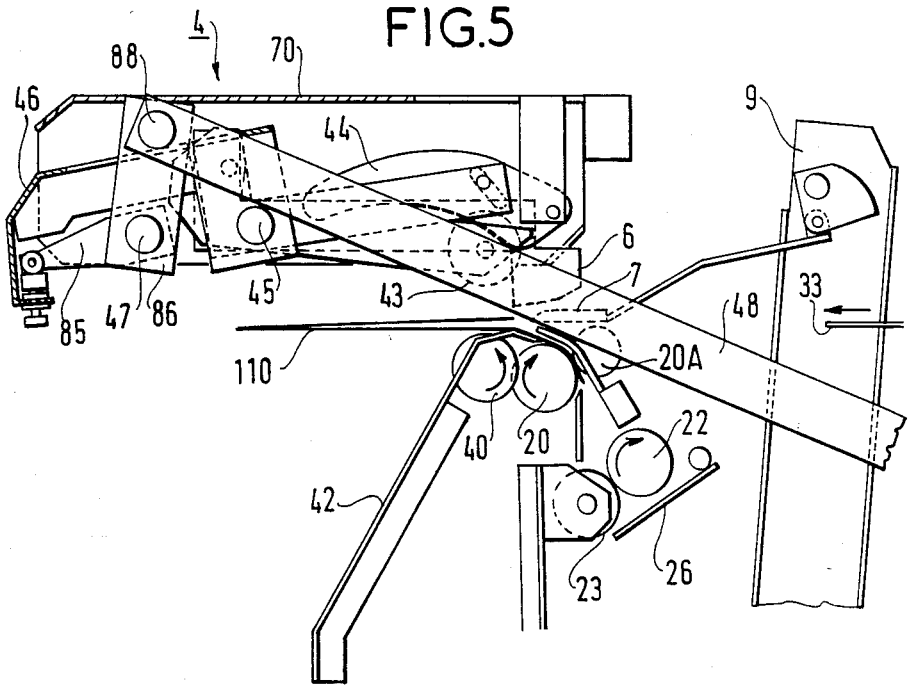
FIGS. 5, 6, 7, and 8 are diagrammatic views showing the operation of the ejection device relative to other components of the machine shown in FIG. 1.

FIG. 5 shows the ejection device 4 at the beginning of the carriage advance sequence. The carriage 33 is still at a distance from the insertion station whose inlet is defined by the wheel 20 and above all by the wheel 40. The carriage control lever is substantially in its position marked P1 in FIG. 1 and the clock is at position H1 as defined by the coding disk and the sensor shown in FIG. 4. Drive is applied to the extraction wheel 22 for extracting an empty envelope which has its backing wheel 23 pressed thereagainst, to the outlet wheel 20 from the empty envelope transfer device, and to the ejection wheel 40. The previously filled envelope has already been evacuated and is no longer visible, and an empty envelope 110 arrives and takes up its position in the insertion station. The empty envelope is held solely by the wheel 20 at the outlet from the device 2 and by its backing wheel referenced 20A.

By virtue of the wheel 53 (FIG. 4) engaging the portion 101 of the ejection cam 52, the lever 46 for controlling the tilting components of the device 4 is itself in its driven position and as a result the ejection backing wheel 43, the tilting fingers 44, and the anti-return lugs 6 are all in their raised positions. They do not get in the way of an empty envelope 110 arriving in the insertion station. By virtue of the wheel 56 (FIG. 4) engaging the portion 105 of the envelope body opening cam 55, the lever 9 has retracted the opening fingers 7 before the inlet to the insertion station to allow the empty envelope to move into place.

Figure 6:
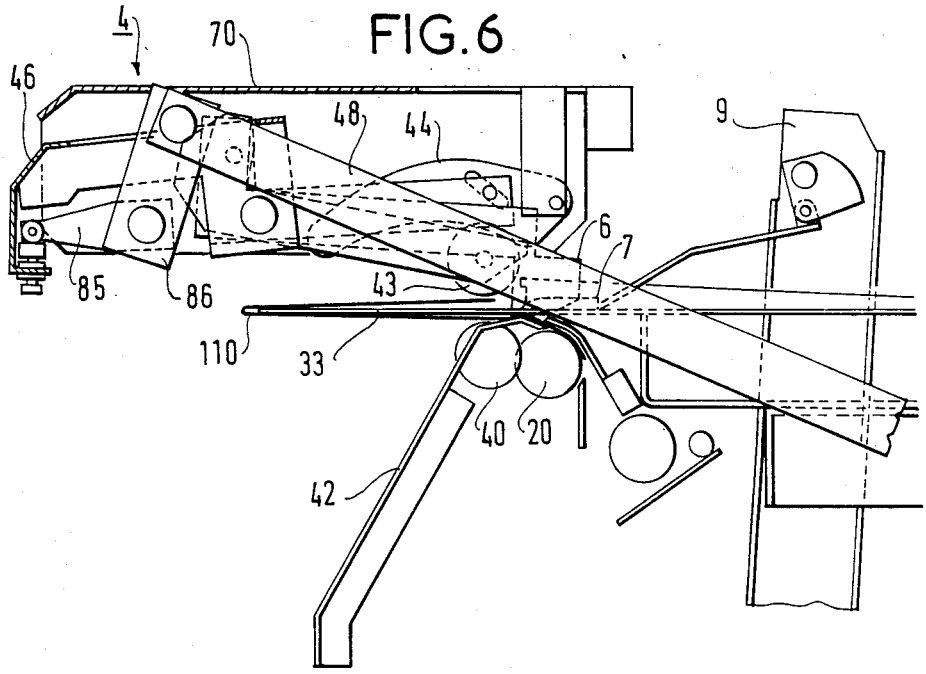

FIG. 6 shows the filled envelope ejection device 4 at the end of the carriage advance sequence with the carriage 33 engaged in the empty envelope 110 present in the insertion station and extending practically to the bottom of the envelope. Simultaneously, the sequence for retaining the sheet in the envelope 110 takes place.

Under the conditions shown in FIG. 6, the control lever of the carriage 33 is substantially in its position marked P2 (FIG. 1) and the clock is in position H25 as given by the sensor and the coding disk of FIG. 4.

Between the position shown in FIG. 5 and that shown in FIG. 6, the wheels 20 and 40 have been stopped, as soon as the empty envelope 110 was put into place in the insertion station.

Between the positions shown in FIGS. 5 and 6, by virtue of the wheel 56 engaging the portion 106 of the envelope body opening cam 55 and having only just released said portion, the envelope body opening fingers 7 have also been engaged in the body of the envelope, thereby facilitating engagement of the carriage 33 together with the sheet it is carrying into the envelope. These opening fingers 7 are then immediately retracted from the envelope body while the sheet is held in the envelope from signal H25 by the lugs 6 in order to allow the carriage free to withdraw on its own starting from H28.

To this end, by virtue of the wheel 53 coming into engagement with the portion 102A of the ejection cam 52 the lever 46 is put into an intermediate position, as shown, in order to retain the sheet. The ejection backing wheels 43 are in an intermediate low position but they remain at a distance from the wheels 40, the tilting fingers 44 are in an intermediate part-tilted position but they have not yet reached their ejection position, while the anti-return lugs 6 are in their low position in which they are flush with or come gently into abutment against the carriage 33 beyond the end of the sheet inserted in the envelope.

At the end of this carriage advance sequence, as at the beginning of carriage return, carriage displacement is caused to take place slowly by virtue of its control system based on the cam shaft of the control assembly 5.

FIG. 7 shows the ejection device 4 during the carriage return sequence and at the beginning of the ejection sequence, i.e. in the first tilting subsequence, for which the carriage 33 has just left the currently filled envelope designated by the reference 110 which is still in the insertion station. The carriage control lever is substantially in its position referenced P3 in FIG. 1 and the clock is at position H44 as given by the sensor and the coding disk of the FIG. 4 control assembly.

Under these conditions, by virtue of the wheel 53 engaging the portion 102B of the ejection cam 52 and then the following portion 103, the lever 46 continues to move towards the raised position as shown. The ejection backing wheels 43 move progressively towards their low ejection position in order to press against the wheels 40 with the envelope body being clamped therebetween, at that portion of the envelope adjacent to its flap which is still held between the wheel 20 and its backing wheel. The tilting fingers 44 also move into their ejection positions, thereby greatly increasing the tilt imparted to the filled envelope 111 by the backing wheels 43 pressing against the wheels 40 so as to push the envelope down and press the body of the filled envelope against the sloping guide 42. The wheels 20 and 40 are still not driven.

The anti-return lugs 6 for preventing the sheet inserted in the envelope from leaving the envelope remain substantially in their preceding low position where they are merely in abutment against the end portion of the carriage 33 which is nearly fully withdrawn from the envelope.

Figure 8:
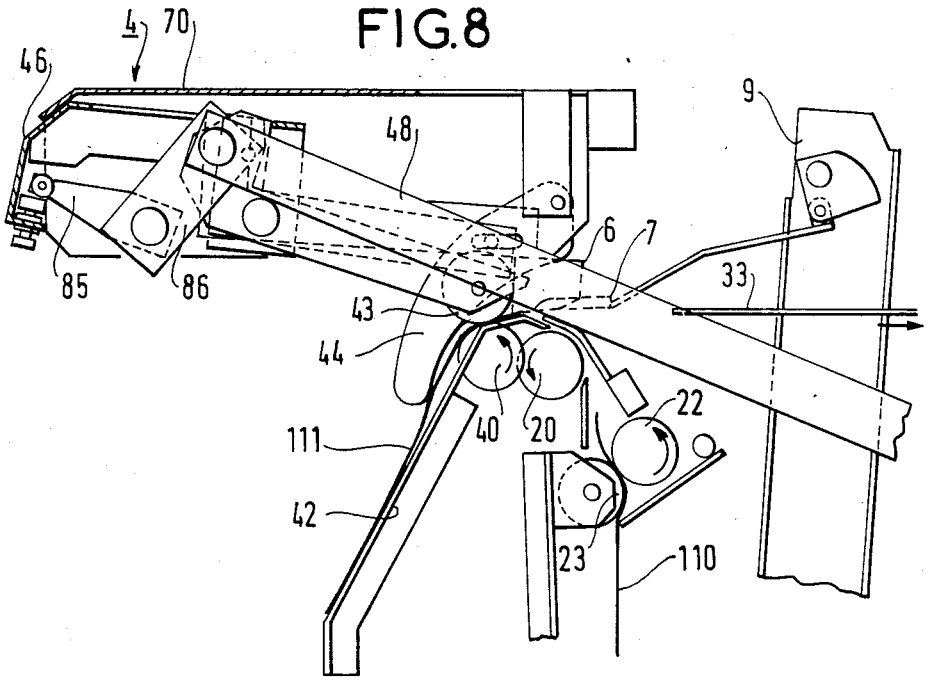

FIG. 8 shows the ejection device 4 still during the carriage return sequence and the ejection sequence, but this time in the second or ejection and transfer subsequence of said ejection sequence. The control lever of the carriage is substantially in its position marked P4 in FIG. 1, and the clock is a little beyond clock position H45, namely in position H48 as given by the sensor and the coding disk of the control assembly in FIG. 4. The wheels 20 and 40 are now driven.

Under these conditions, by virtue of the wheel 53 continuing to be active against the portion 103 of the ejection cam 52, the lever 46 is in its non-driven position in the ejection device 4, as shown. The tilting fingers 44 have pressed the body of the envelope against the inclined guide 42. Simultaneously, the backing wheels 43 are pressed hard against the driven wheels 40, thereby causing the filled envelope 111 to be evacuated and to slide along the inclined guide and be received in the horizontal reception chute beneath said guide.

While the filled envelope 111 is being evacuated from the insertion station, a new empty envelope 110 is driven towards the insertion position, a new empty envelope 110 is driven towards the insertion position by virtue of the backing wheel 23 pressing again against the wheel 22 (it was retracted away therefrom in the positions shown in FIGS. 6 and 7 in order to leave the transfer station 2 free to receive a new empty envelope), with the wheels 20 and 22 being driven simultaneously with the wheel 40.

This new empty envelope will take the place of the filled envelope 111 which is evacuated before the empty envelope 110 reaches the inlet to the insertion station. The tilting fingers 44, the ejection backing wheels 43, and the anti-return lugs 6 are rapidly returned to their raised positions as shown in FIG. 5 while the wheels 22, 20, and 40 continue to be driven in order to bring the new empty envelope freely into the insertion station.

Figure 9:
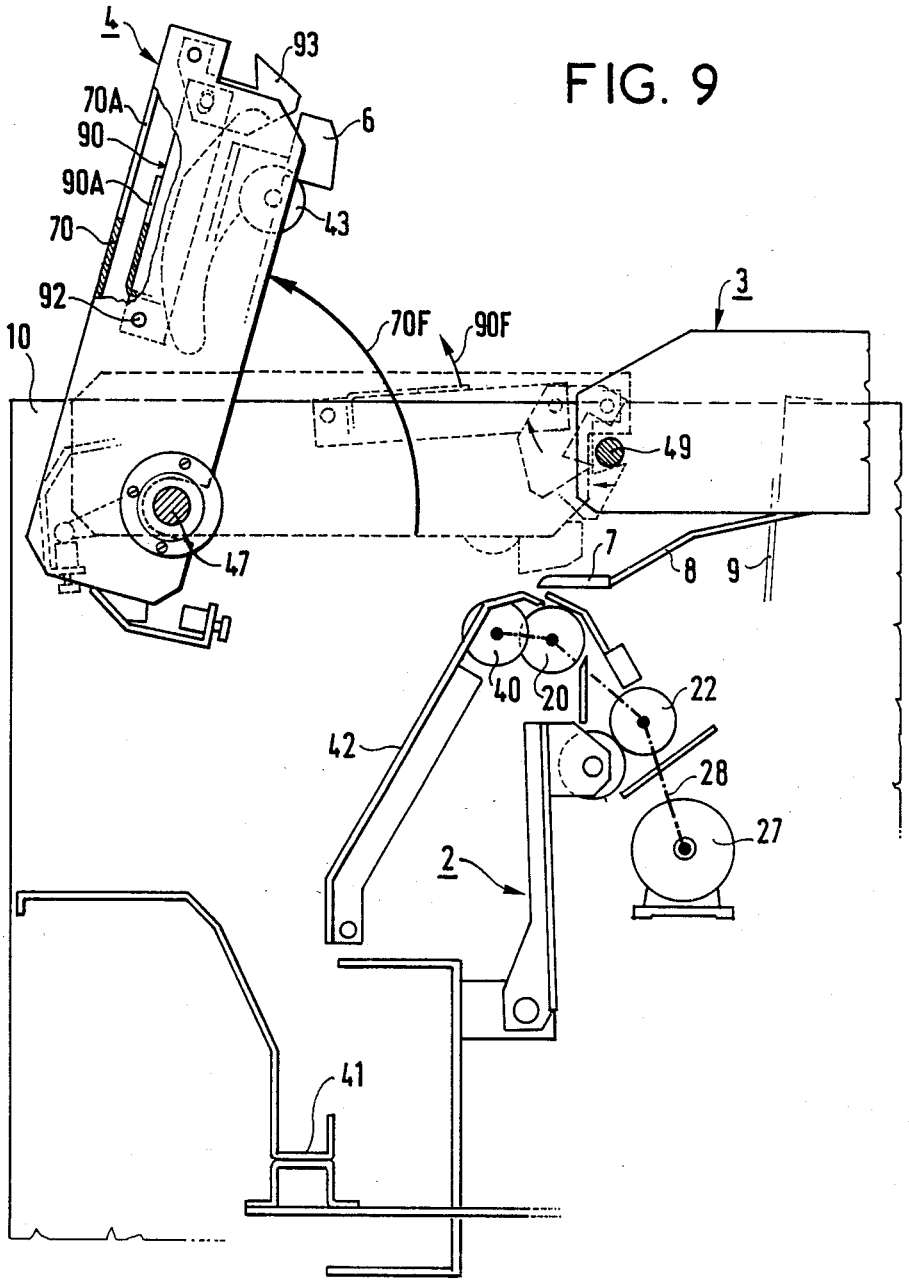
FIG. 9 shows how the ejection device is mounted in the machine.

FIG. 9 also shows how the ejection device 4 is mounted in the body (referenced 10) of the insertion machine. The frame 70 is either locked in the body 10 as shown by dashed lines or else it is raised to an open position as shown by solid lines.

It can be seen that the frame 70 of the device 4 together with all of the items carried thereby constitutes a subassembly which is mounted in the machine in a manner which is independent from the devices 2 and 3 and from the evacuation wheels 40. The wheels 40, the device 2, and at least a portion of the device 3 are mounted directly in the body 10 and the device 4 is associated therewith by the frame 70 being locked to the body 10.

The frame 70 occupies only a portion of the top of the body 10, and in this case the lefthand side. It is pivotally mounted at one end about the shaft 47 which is fixed relative to the body 10, and it is carried at its other end by the shaft 49 which is also mounted in the body 10 and is located substantially one third of the way along the body counting from the shaft 47. The shaft 49 also carries the transfer device 3 which engages in the end of the ejection device 4 as shown in FIG. 2 when the device 4 is locked on the shaft 49.

Carried in this way on the two shafts 47 and 49, the end of the frame 70 which houses the tilting means such as 43 comes immediately over the wheels 20 of the empty envelope transfer device 2 and the wheels 40 which similarly belong to the ejection device 4, and immediately facing the sheet transfer device 3, as can also be seen in FIG. 1. When hand pressure is applied to the piece 90 in the direction of arrow 90F the frame 70 is unlocked from the support shaft 49, and on releasing the shaft 49 it is lifted to pivot along arrow 70F about the shaft 45 into an open position.

When in this open position, the frame 70 gives access to the various items carried therein, but above all it gives access to the inside of the machine at the wheels 20 and 40, thereby making it possible to clear paper jams that may occur in the insertion station during operation of the machine when successive empty envelopes arrive in the insertion station or when sheets are inserted into the envelopes, or when the envelopes are ejected.

The main advantages of the ejection device and the insertion machine according to the present invention in addition to the unlockable and pivoting mount of the ejection device 4, include:

- particularly small dimensions giving rise to a machine which is compact, in particular by virtue of the ejection device which causes the filled envelopes to be tilted down into a reception and transfer chute which is adjacent and parallel to the empty envelope arrival chute;
- reliability of machine operation with the successive insertion cycles of the machine, be they under mechanical or electronic control, being defined with precision relative to one another and giving rise to specific commands triggered relative to successive angular positions of a single controlling drive shaft. These successive angular positions are detected during each complete rotation of the drive shaft and a reference angular position is also detected, once during each complete rotation of the shaft, i.e. once per cycle;
- the insertion cycle rate can easily be adapted to machine utilization requirements merely by changing the speed of said drive shaft; and
- the simplicity of the control assembly and of the various different devices within the machine engaged with the drive shaft which has only a small number of cams (a single ejection cam and a single envelope body opening cam and a crank and rod system), together with a coding disk for generating mechanical commands and electronic commands in accordance with sequences which are mutually well defined.

The present invention has been described with reference to the embodiment shown in the accompanying drawings. Clearly detail modifications could be made thereto and/or various means could be replaced by equivalent means without thereby going beyond the scope of the present invention.

I claim:

1. An ejection device for ejecting filled envelopes from an insertion station in which sheets are filled into successive envelopes that are brought empty into said station, the device including evacuation means which are operated after each insertion and further including tilting means for tilting said filled envelopes and mounted facing said evacuation means, at least in part, actuator means for actuating the tilting means between a first or "raised" position in which they are at a distance from the plane of the insertion station and leave the station free to be fed with an empty envelope, and a second or "low" ejection position interferring with the plane of the insertion station and pressing said filled envelope against said evacuation means, and reception means for receiving filled envelopes which are evacuated, said reception means being mounted substantially transversely relative to the plane of the insertion station and being coupled to said evacuation means by said tilting means when the tilting means are actuated to take up their low ejection position.

2. An ejection device according to claim 1, wherein said evacuation means are mounted on a first side of the plane of the insertion station and substantially level with the envelope inlet into the insertion station, and said tilting means are pivotally mounted on the other side of the plane of the insertion station at least where they face said evacuation means.

3. An ejection device according to claim 2, wherein said tilting means include at least one evacuation backing wheel carried by a first lever of the tilting means, said lever being coupled to said actuator means.

4. An ejection device according to claim 2, wherein said tilting means include at least one tilting finger coupled to a second lever of the tilting means, which lever is itself coupled to said actuator means.

5. An ejection device according to claim 4, wherein said tilting finger is hinged at a first one of its ends about a fixed hinge pin and is hinged at an intermediate portion which is coupled to said second lever about a stud carried by said second lever and slidably mounted in a window through said intermediate portion of said tilting finger.

6. An ejection device according to claim 3, wherein said levers of the tilting means are substantially L-shaped, carrying said tilting means at the ends of their long arms, hinged substantially at their junctions between their arms about a fixed hinge axis, and coupled by their short arms to said actuator means.

7. An ejection device according to claim 6, wherein said actuator means include a control lever.

8. An ejection device according to claim 7, wherein said control lever is substantially in the form of an upsidedown channel section member, referred to as the lever frame of the tilting means, and has a window through the web of its channel section receiving the short arms of the levers of the tilting means, and wherein said levers of the tilting means are resiliently mounted by springs to come into abutment against said window, in order to provide coupling between said lever frame and the levers of the tilting means.

9. An ejection device according to claim 8, wherein said actuator means comprise said lever frame receiving said levers of the tilting means mounted in abutment in said window substantially at a first end of said lever frame, said lever frame being firstly pivotally mounted about the fixed hinge shaft of said levers of the tilting means, and being secondly coupled at its other end to the control means.

10. An ejection device according to claim 9, wherein said control means comprise a control drive shaft, a first "ejection" cam carried by said drive shaft, and a link controlled by said ejection cam and controlling said lever frame to which it is coupled.

11. An ejection device according to claim 9, wherein said lever frame carries an internal abutment buffer substantially at its second end opposite to said first end, said buffer serving as an abutment for a terminal of a linkage providing coupling between said lever frame and said control means.

12. An ejection device according to claim 11, wherein said abutment buffer is adjustably mounted relative to the flanges of the channel section member of the frame.

13. An ejection device according to claim 10, wherein said ejection cam has at least one first peripheral zone and one second peripheral zone for putting said tilting means into the first "raised" position and into the second low or ejection position, respectively.

14. An insertion machine for inserting sheets into envelopes, and making use of said ejection device according to claim 1, and further including an empty envelope transfer device in which envelopes are received separate from one another via an arrival chute which is coupled to the inlet of the insertion station, a sheet transfer device in which sheets are received separately from one another on an inlet tray coupled to the inlet of the insertion station, and a control assembly for controlling said devices to perform sequences which are defined relative to each other for each machine cycle, referred to as an insertion cycle, wherein said arrival chute of the empty envelope transfer device and said reception means for receiving filled envelopes evacuated from the ejection device are substantially adjacent and mounted in the proximity of the inlet to said insertion station for the purpose of conveying envelopes along two substantially parallel paths extending substantially transversely relative to the plane of the insertion station.

15. An insertion machine according to claim 14, wherein said control assembly includes a coding disk mounted on a control drive shaft and a sensor associated with said disk and delivering clock signals representing different angular positions of said shaft, with said sequences for each insertion cycle for each complete rotation of said shaft being defined on the basis of said clock signals.

16. An insertion machine according to claim 15, wherein said drive shaft also carries a first or "ejection" cam for controlling the ejection device, said cam having at least two distinct peripheral portions for controlling said tilting means to occupy said high position and said low ejection position, respectively.

17. An insertion machine according to claim 16, wherein said drive shaft also carries a second cam for controlling opening fingers for opening the body of an empty envelope present in the insertion station, said second cam being disposed relative to said first ejection cam to command the following actions in succession: the tilting means are raised; the opening fingers are inserted into the body of the envelope in order to open it; the opening fingers are withdrawn from the envelope; and the tilting means are moved to their low "ejection" position.

18. An insertion machine according to claim 17 and in which said sheet insertion device includes a carriage movable in translation at least between said inlet tray and said insertion station for coupling said tray to said station, and for inserting the sheets taken from said inlet tray into the envelope present in the insertion station, the insertion machine being wherein it further includes anti-return lugs for preventing the sheet loaded into said envelope from returning, said lugs being mounted in said ejection device and being coupled to said tilting means in order to be controlled in conjunction with said tilting means by said ejection cam which is provided with an additional, third peripheral portion which is transitional between said first and second peripheral portions and which serves for placing said tilting means in an intermediate position between said raised position and said low ejection position and which serves simultaneously for putting said anti-return lugs substantially into contact with said carriage inserted in said envelope.

19. An insertion machine according to claim 17, further including a crank and rod system mounted on said drive shaft in order to be controlled by said shaft, said system being coupled to said carriage in order to drive it once back and forth in translation during each full revolution of said shaft.

20. An insertion machine according to claim 15, wherein said coding disk has a non-looped series of first openings disposed substantially at its periphery at a regular pitch and defining a gap in which there are no first openings.

21. An insertion machine according to claim 20, wherein said coding disk also has a second opening which is radially offset relative to said series of said first openings and which at least partially overlaps said gap having no first openings, with said sensor being constituted by a pair of sensors for detecting the passage of said first openings and for detecting the passage of said second opening, respectively.

22. An insertion machine according to claim 21, wherein said pair of sensors is connected to a counter, and wherein said first detected openings are used for delivering a sequence of clock signals and said second opening is used for delivering a reference signal for resetting said sequence of clock signals.

23. An insertion machine according to claim 22, wherein the individual sensors of said pair of sensors include optical fibers respectively coupled to two emitting cells in order to detect said openings from a distance.

24. An insertion machine according to claim 23, wherein said second opening is at least twice as long as any one of said first openings and overlaps, at least in part, the terminal first opening giving rise to the last clock signal of said sequence, with said individual sensors being angularly offset relative to each other in order to detect said first and second openings, respectively.

25. An insertion machine according to claim 14, wherein said tilting means of said ejection device are mounted coupled together to a first control means belonging to said actuator means in a support frame which is itself pivotally mounted about a first support shaft of a body of the machine and locked by manually operable unlocking means to a second support shaft of said body, and wherein said evacuation means and said reception means are directly carried by said body.

26. An insertion machine according to claim 25, wherein said sheet transfer device is also carried at least by said second support shaft, with the sheet transfer device and the ejection device having their corresponding ends engaged in each other.

* * * * *